US007597086B2

(12) United States Patent
Kuji et al.

(10) Patent No.: US 7,597,086 B2
(45) Date of Patent: Oct. 6, 2009

(54) THROTTLE ASSEMBLY FOR INTAKE AIR AND V-TYPE ENGINE THEREWITH

(75) Inventors: Yasuhiro Kuji, Kako-gun (JP); Akinobu Wakabayashi, Kobe (JP); Yoshiyuki Ayakoji, Odawara (JP); Jun Kiyono, Odawara (JP); Isamu Tanaka, Odawara (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 12/073,319

(22) Filed: Mar. 4, 2008

(65) Prior Publication Data

US 2008/0216794 A1 Sep. 11, 2008

(30) Foreign Application Priority Data

Mar. 5, 2007 (JP) ..... P2007-054426

(51) Int. Cl.
*F02D 9/10* (2006.01)

(52) U.S. Cl. ..... 123/336; 123/337; 123/399; 123/195 C; 123/579; 123/580; 123/583

(58) Field of Classification Search ..... 123/336, 123/337, 399, 195 C, 579, 580, 583
See application file for complete search history.

(56) References Cited

U.S. PATENT DOCUMENTS

| | | | | |
|---|---|---|---|---|
| 4,016,838 | A * | 4/1977 | Yoshioka et al. | 123/583 |
| 4,970,999 | A * | 11/1990 | Jingu et al. | 123/195 C |
| 5,375,569 | A * | 12/1994 | Santella | 123/90.38 |
| 5,803,044 | A * | 9/1998 | Kato | 123/336 |
| 6,382,196 | B2 * | 5/2002 | Kawamoto et al. | 123/580 |
| 6,684,836 | B2 * | 2/2004 | Inoue | 123/90.17 |
| 7,032,569 | B2 * | 4/2006 | Ikeda et al. | 123/399 |

FOREIGN PATENT DOCUMENTS

JP 2004-239234 8/2004

* cited by examiner

*Primary Examiner*—Erick Solis
(74) *Attorney, Agent, or Firm*—Wenderoth, Lind & Ponack, L.L.P.

(57) ABSTRACT

A throttle assembly for intake air protects a link mechanism for interlocking throttles with each other from water and mud and maintains the throttle operability in a satisfactory state. The throttle assembly for intake air includes a plurality of throttle devices for injecting fuel into intake air to generate an air-fuel mixture; a link mechanism for connecting driving portions of the throttle devices with each other, a link mechanism housing chamber defined by an outer wall member for forming a link mechanism housing chamber and housing the link mechanism, and seal members provided at the connected or mated portions of the outer wall member and a different member or the connected or mated portions of a plurality of outer wall configuring members which configure the outer wall member.

15 Claims, 8 Drawing Sheets

THROTTLE ASSEMBLY FOR INTAKE AIR AND V-TYPE ENGINE THEREWITH

BACKGROUND OF THE INVENTION

1. Field of the Invention

The present invention relates to a throttle assembly for intake air. More specifically, the present invention relates to a throttle assembly for intake air, which includes a plurality of throttle devices for injecting fuel into intake air to generate air-fuel mixture and a power transmission mechanism for connecting drivingly driving portions of the throttle devices with each other and a V-type engine therewith.

2. Description of the Prior Art

Japanese Patent Application Laid-Open No. 2004-239234 discloses a V-type engine including a power transmission mechanism such as a link mechanism for connecting throttle devices with each other. The link mechanism is accommodated in a link mechanism housing chamber defined by an outer wall member, whereby, the link mechanism is protected from stones, sand or dust. FIGS. 7, 8, and 9 show an example of a conventional V-type engine. In FIG. 7, the V-type engine includes first and second throttle devices 101 and 102 for supplying air-fuel mixture into cylinders of the engine respectively, and a link member (link mechanism) 115 for connecting drivingly driving portions of the throttle devices 101 and 102 with each other. The driving portions of the throttle devices 101 and 102 are, for example, constituted by throttle valve driving shafts 111 and 112 with swinging arms 113 and 114. Both the swinging arms 113 and 114 are connected by the link member 115 each other. Moreover, one swinging arm 113 is connected with one end of a cable device 120 as shown by an imaginary line. Other end of the cable device 120 is extended to a throttle operating portion of a throttle grip 121 and connected thereto. Whereby, the throttle devices 101 and 102 can be operated by the same amount of rotation at the same time.

The link member 115 and the swinging arms 113 and 114 are accommodated in a link mechanism housing chamber 110 surrounded by a link case 103 coupled to throttle bodies of the throttle devices 101 and 102 and a case cover 104 as shown in FIG. 8.

As shown in FIG. 9, in the cable device 120, an end male thread portion 127 of an outer cable 120*b* of the cable device 120 is fitted into a groove or notch 123 formed in a front wall of the link case 103, a pair of nuts 124 and 125 are threaded to the end male thread portion 121, the front wall of the link case 103 is sandwiched between the nuts 124 and 125 from front and rear of the link case 103, and the outer cable 120*b* is fixed to the link case 103. As shown in FIG. 7, a drain hole 130 for discharging water or the like in the link mechanism housing chamber 110 is formed in a lower wall of the link case 103.

The link case 103 and the case cover 104 shown in FIGS. 7 to 9 mainly protect the link member 115 from a stone, sand, or dust. The link case 103 and the case cover 104 do not include any special configuration for preventing the entry of water and mud into the link mechanism housing chamber 110.

As shown in FIGS. 7 to 9, in the V-type engine allowing the entry of water and mud into the link mechanism housing chamber 110, in the event that water and mud adhere to the movable portions of the link member 115, e.g., the rotating and coupling portions at the front and rear ends of the link member 115 or that mud is accumulated near the swinging arm 114 on the rear side of the link member 115, rust can occur or the operation of the link member 115 and the swinging arm 114 can be failed. In many cases, the V-type engine mounted on a four wheeled vehicle for irregular ground, which runs on a field, sandy beach, or rough ground is driven in an environment in which it suffers from water and mud together with a stone or sand or the like. The link mechanism housing chamber 110 is strongly required to prevent water and mud.

SUMMARY OF THE INVENTION

The present invention addresses the above described condition, and an object of the present invention is to provide a throttle assembly for intake air, which can protect a power transmission mechanism for connecting throttle devices with each other, such as a link mechanism, from water and mud together with a stone or sand from outside and can perform satisfactory throttle operation all the time and a V-type engine therewith.

To address the above described condition, a throttle assembly for intake air according to the present invention includes a plurality of throttle devices for injecting fuel into intake air to generate air-fuel mixture, a power transmission mechanism for connecting drivingly driving portions of the throttle devices with each other, a power transmission mechanism housing chamber defined by an outer wall member for forming a power transmission mechanism housing chamber and accommodating the power transmission mechanism, and seal means provided to connected or mated portions of the outer wall member and a different member, or connected or mated portions of a plurality of outer wall components which configure the outer wall member.

With the above configuration, the power transmission mechanism for connecting the throttle devices with each other, such as a link mechanism, can be protected from stones or sands from outside. Moreover, entry of water and mud into the power transmission mechanism housing chamber and occurrence of rust in the power transmission mechanism can be prevented. Whereby, satisfactory operation of the throttle devices can be maintained.

Preferably, as the seal means, a seal member may be disposed between a mating faces of the outer wall member and a throttle body of the throttle device as the different member.

With the above configuration, the entry of water and mud from the mating faces of the throttle body and the housing chamber case into the power transmission mechanism housing chamber and the throttle device can be prevented.

Preferably, a plurality of outer wall components which configure the outer wall member may be a housing chamber case and a case cover coupled to a mating face of the housing chamber case, and the seal means may be a seal member disposed on the mating face.

With the above configuration, the entry of water and mud from the mating faces of the housing chamber case and the case cover into the power transmission mechanism housing chamber can be prevented, and removal and maintenance of the power transmission mechanism can be easily done by removing the case cover from the housing chamber case.

Preferably, the seal means may include a cable insertion hole formed in the outer wall member and having a female thread portion, and the cable insertion hole allows a pipe-shaped connecting portion coupled to an end of a cable for throttle operation as the different member to be threaded thereinto.

With the above configuration, an outer cable of the cable device can be firmly fixed to the outer wall member for forming the power transmission mechanism housing chamber, and the seal performance in the cable insertion hole against water can be maintained high.

Preferably, the outer wall member may include a breather hole for communicating an inside and an outside of the power transmission mechanism housing chamber.

With the above configuration, in the event that the air pressure in the sealed power transmission mechanism housing chamber is changed due to temperature change, pressure change can be immediately buffered by breathing of the breather hole and the entry of water from outside due to pressure change can be prevented.

Preferably, the breather hole may include a connecting portion for connecting a breather pipe communicated with an air cleaner of an engine.

With the above configuration, since the connecting portion provided in the breather hole can communicate the breather hole with the air cleaner, the entry of water from the breather hole into the link mechanism housing chamber can be prevented. Moreover, the throttle assembly includes the breather pipe having a breather branch pipe communicated with a throttle position sensor chamber of the throttle device, so that outer piping for breather can be simplified.

The present invention provides a V-type engine including the throttle assembly for intake air.

BRIEF DESCRIPTION OF THE DRAWINGS

The above and other objects, features and advantages of the present invention will be become more apparent from the following description taken in connection with the accompanying drawings, in which.

DETAILED DESCRIPTION OF THE PREFERRED EMBODIMENTS

First Embodiment

FIGS. 1 to 6 show a two-cylinder V-type engine for a vehicle including a throttle assembly for intake air according to the present invention. An embodiment of the present invention will be described based on these drawings.

(The Overall Configuration of an Engine)

Figure 1:
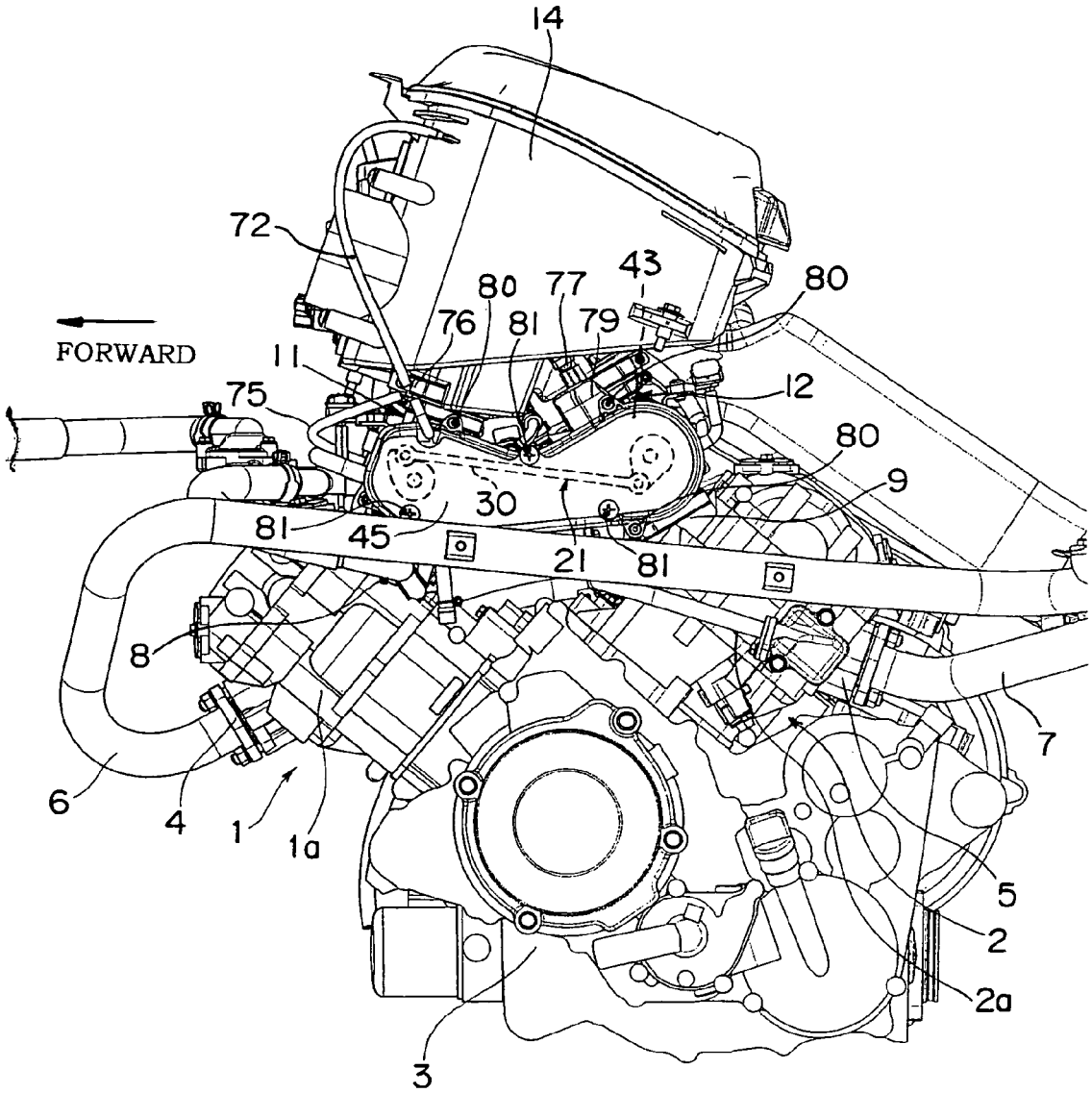
FIG. 1 is a left side view showing an embodiment of a V-type engine including a throttle assembly for intake air according to the present invention.

FIG. 1 is a left side view of a V-type engine. A first cylinder 1 tilted forward and a second cylinder 2 tilted rearward are disposed on the upper portion of a crankcase 3 in V shape, when viewed from the side of the V-type engine. Exhaust ports 4 and 5 are provided on a front lower surface of a cylinder head 1*a* of the first cylinder 1 and a rear lower surface of a cylinder head 2*a* of the second cylinder 2, respectively. The exhaust ports 4 and 5 are connected to exhaust pipes 6 and 7, respectively. The exhaust pipes 6 and 7 are extended rearward and connected to an exhaust muffler (not shown) arranged rearwardly of the V-type engine.

Intake ports 8 and 9 are provided on a rear upper surface of the cylinder head 1*a* of the first cylinder 1 and a front upper surface of the cylinder head 2*a* of the second cylinder 2, respectively. The intake ports 8 and 9 are connected to intake outlets of first and second throttle devices 11 and 12, respectively. The intake inlets provided at upper ends of the throttle devices 11 and 12 are communicated with a clean side portion of an air cleaner 14 arranged above the throttle devices 11 and 12.

(The Configuration of the Throttle Devices 11 and 12 and a Link Mechanism 21)

Figure 2:
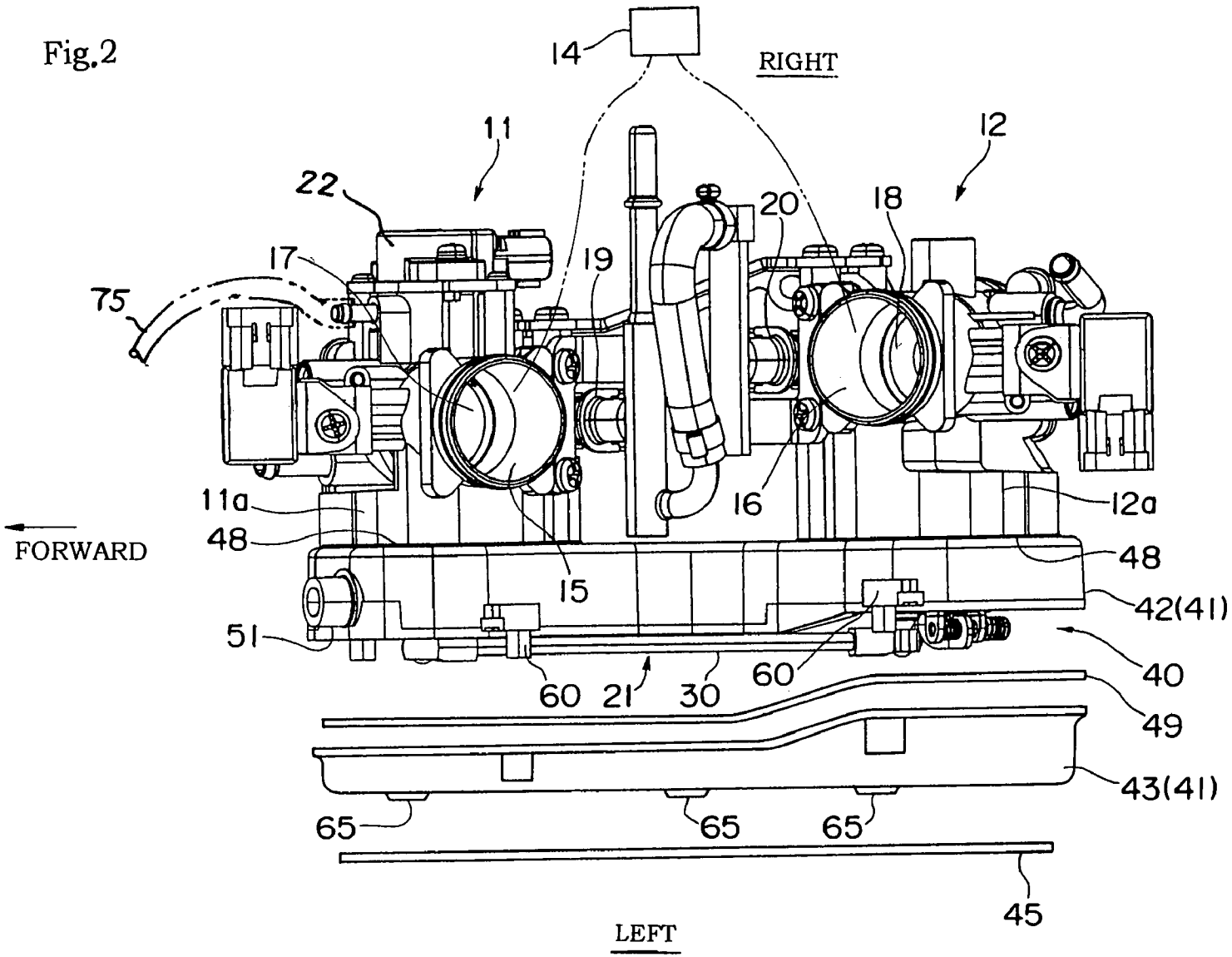
FIG. 2 is an enlarged plan view of throttle devices and a link mechanism of the V-type engine of FIG. 1.
Figure 3:
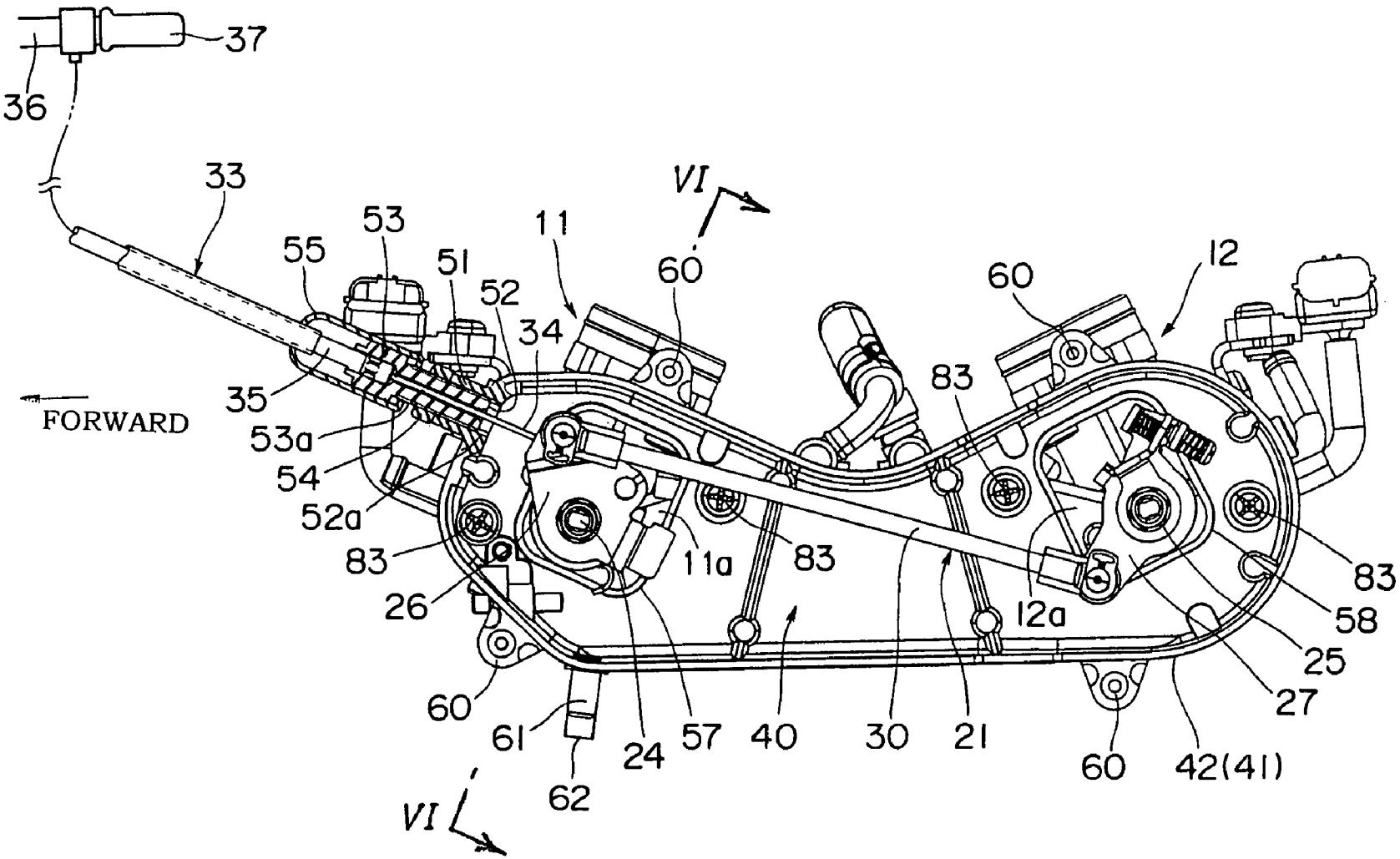
FIG. 3 is an enlarged left side view of the link mechanism (power transmission mechanism) of FIG. 1.

FIG. 2 is an enlarged plan view of the throttle devices 11 and 12 and a link mechanism (transmission mechanism) 21 for connecting throttles with each other. FIG. 3 is an enlarged left side view of the link mechanism 21. In FIG. 2, the first and second throttle devices 11 and 12 include rotatable throttle valves (butterfly valves) 17 and 18 in intake passages 15 and 16 formed in throttle bodies 11*a* and 12*a*, respectively. The first and second throttle devices 11 and 12 also include fuel supply mechanisms 19 and 20, respectively, for injecting fuel to intake air supplied from the air cleaner 14 to the intake passages 15 and 16 to generate an air-fuel mixture. Further, a throttle position sensor chamber 22 is provided on the right side of the first throttle device 11.

In FIG. 3, throttle valve driving shafts (driving portions) 24 and 25 are projected leftward from left end faces of the throttle bodies 11*a* and 12*a*, respectively. Swinging arms 26 and 27 are fixed to left ends of the throttle valve driving shafts 24 and 25, respectively. The swinging arm 26 of the first throttle device 11 is extended substantially upward. The swinging arm 27 of the second throttle device 12 is extended substantially downward. Ends of the swinging arms 26 and 27 are connected with each other by a link member 30 tilted rearward and downward to configure the link mechanism 21. That is, the V-type engine includes the link mechanism 21 as a power transmission mechanism. The front and rear ends of the link member 30 of the link mechanism 21 are rotatably coupled to the ends of the front and rear swinging arms 26 and 27.

The end of the swinging arm 26 of the first throttle device 11 is coupled to one end (rear end) of an inner cable 34 of a cable device 33 as well as to the link member 30. The inner cable 34 is extended forward, passes into an outer cable 35, and is connected with a throttle grip (throttle operating portion) 37 provided on a steering handle 36. That is, when the throttle grip 37 is operated to swing the swinging arm 26 of the first throttle device 11 via the cable device 33, the swinging arm 27 of the second throttle device 12 is swung via the link member 30 together with the swinging arm 26 of the first throttle device 11 by substantially the same amount of rotation in the same direction.

(A Link Mechanism Housing Chamber (Power Transmission Mechanism Housing Chamber) 40, an Outer Wall Member 41, and Seal Means 48 and 49)

In FIG. 3, the link member 30, the swinging arms 26 and 27, the left ends of the throttle valve driving shafts 24 and 25 are accommodated in the link mechanism housing chamber 40 surrounded by the outer wall member 41 for forming the link mechanism housing chamber.

In FIG. 2, the outer wall member 41 for forming the link mechanism housing chamber includes a cup-shaped link case 42 removably coupled to left end faces of the throttle bodies

11*a* and 12*a* and a cup-shaped case cover 43 removably coupled to a left end opening end face of the link case 42. A heat shield plate 45 made of metal is removably fitted to a left end face of the case cover 43. Thin plate-like seals (packing) 48 made of expanded rubber are sandwiched between the throttle bodies 11*a* and 12*a* and the link case 42 (or mating faces) as first seal means for preventing the entry of water from the mating faces into the link mechanism housing chamber 40. An O ring 49 which is circular in section and made of expanded rubber is sandwiched between the link case 42 and the case cover 43 (or mating faces) as second seal means for preventing entry of water from the mating faces into the link mechanism housing chamber 40.

Figure 6:
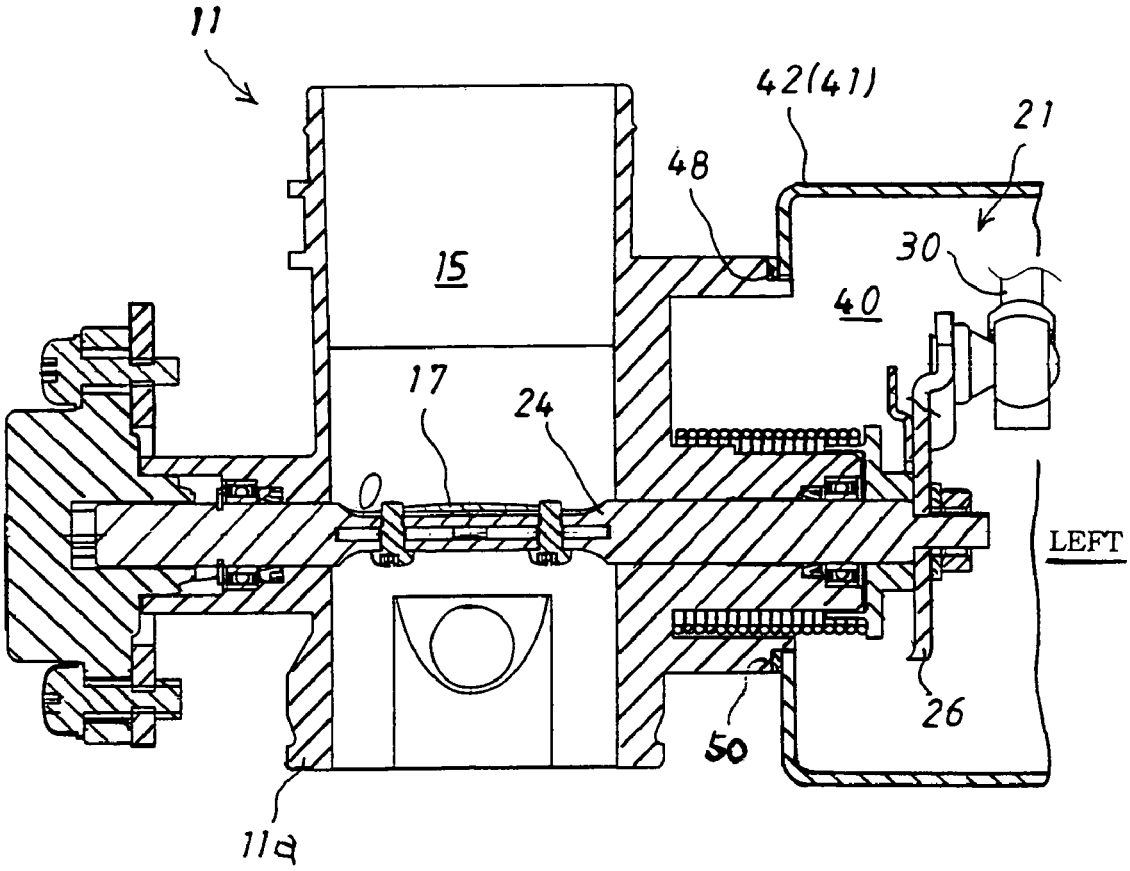
FIG. 6 is an enlarged sectional view taken along line VI-VI of FIG. 3.
Figure 7:
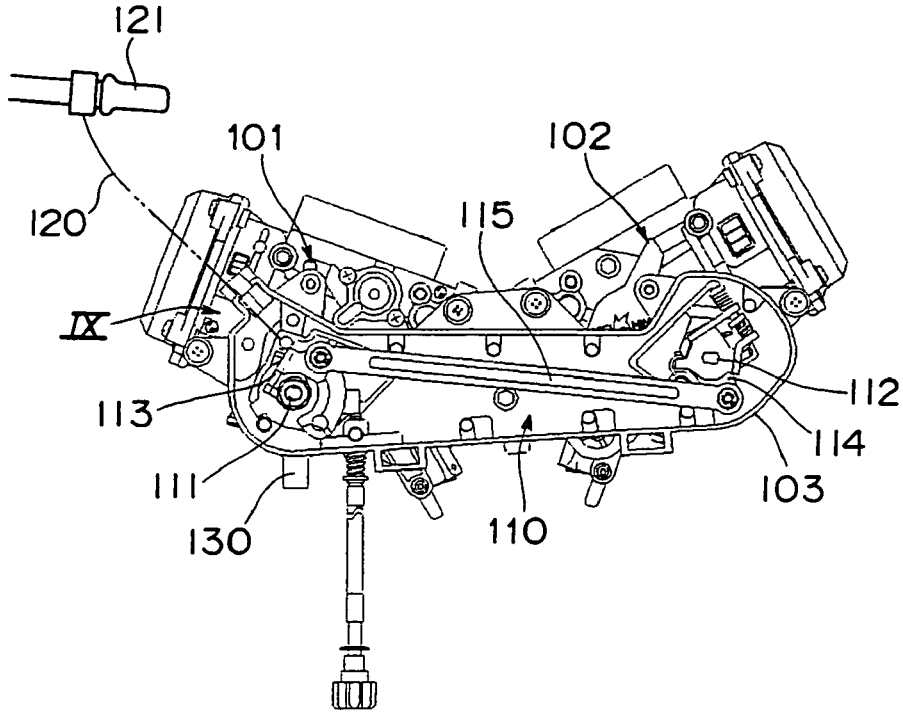
Fig.7 PRIOR ART
FIG. 7 is a side view of a conventional link mechanism (power transmission mechanism) and link case (housing chamber case)
Figure 8:
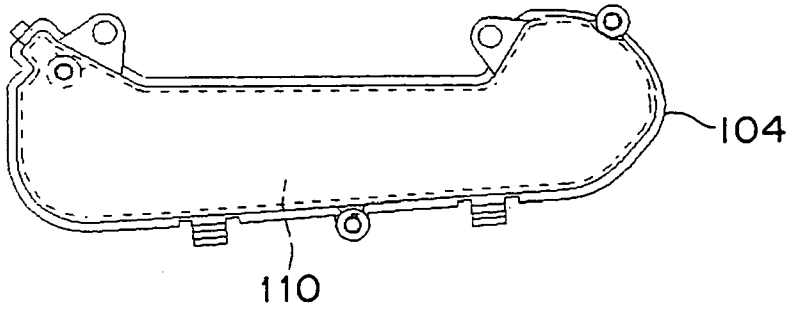
Fig.8 PRIOR ART
FIG. 8 is a side view of a case cover coupled to the link case of FIG. 7.
Figure 9:
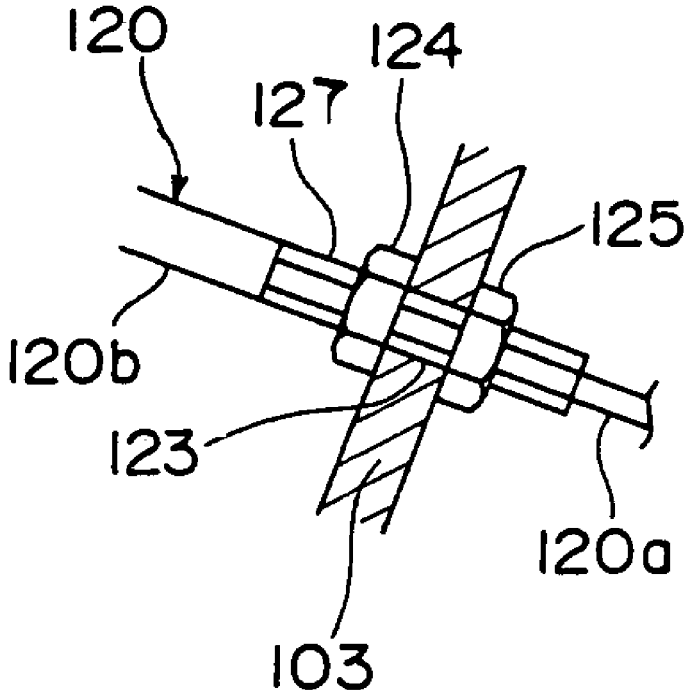
Fig.9 PRIOR ART
FIG. 9 is an enlarged view of the portion indicated by arrow IX of FIG. 7.

FIG. 6 is an enlarged sectional view taken along line VI-VI of FIG. 3 and shows a coupling portion of the throttle body 11*a* of the first throttle device 11 and the link case 42. An annular step 50 is formed on a left end face of the throttle body 11*a* of the first throttle device 11. The annular seal 48 made of resin as the first seal means is arranged on the annular step 50. A right end face of the link case 42 is pressed into contact with the seal 48. A coupling portion of the throttle body 12*a* of the second throttle device 12 and the link case 42 of FIG. 3 has the same configuration as that of FIG. 6.

Returning to FIG. 3, a cylindrical cable fitting boss 51 projected forward and upward is formed in a position near an upper end of a front wall of the link case 42 so as to be integral with the link case 42. A cable insertion hole 52 having a female thread portion 52*a* and communicating an inside and an outside of the link mechanism housing chamber 40 is formed in the cable fitting boss 51. A connection pipe (pipe-shaped connecting portion) 53 having a male thread portion 53*a* is fixed to one end (rear end) of the outer cable 35 of the cable device 33. The connection pipe 53 is threaded into the cable insertion hole 52 of the cable fitting boss 51 and is fixed to the cable fitting boss 51 by a locking nut 54 threaded on the male thread portion 53*a* of the connection pipe 53 so as not to be loosened. A boot 55 made of rubber or resin is fitted from a front portion of the connection pipe 53 to near a rear end of the outer cable 35 so as to cover these from outside.

As third seal means for sealing the link mechanism housing chamber 40 from outside, the cable insertion hole 52 having the female thread portion 52*a* is formed in the cable fitting boss 51 of the link case 42, and the connection pipe 53 provided on the outer cable 35 is threaded into the cable insertion hole 52.

A pair of front and rear cover fitting bosses 60 are formed on an upper wall and a lower wall of the link case 42, respectively. A drain hole 61 is formed in a position near a front end of the lower wall of the link case 42. A plug 62 is removably fitted to the drain hole 61.

Figure 4:
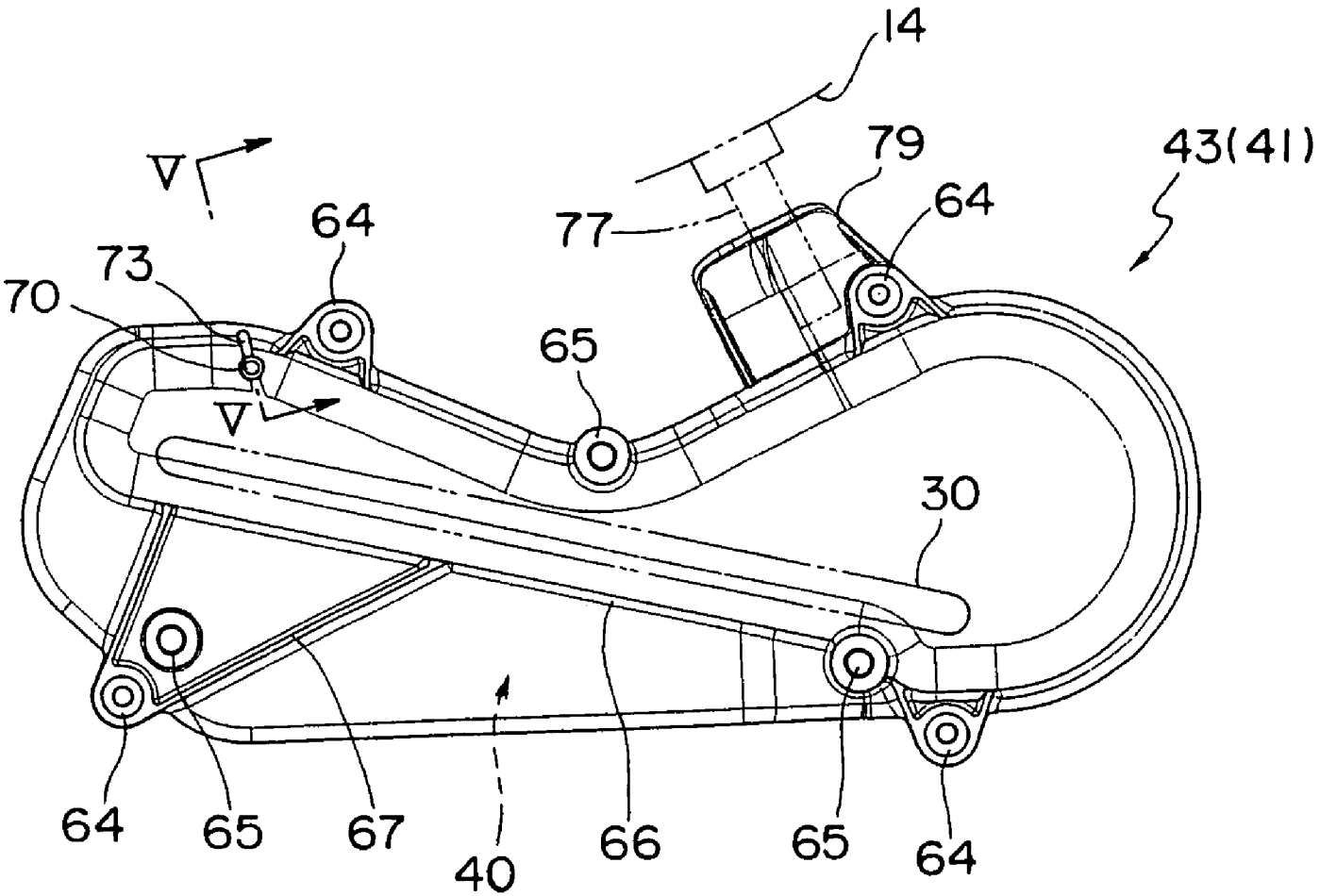
FIG. 4 is a left side view of a case cover of FIG. 2.

FIG. 4 is a left side view of the case cover 43. A pair of front and rear fitted bosses 64 for fitting the cover are formed on the upper wall and the lower wall of the case cover 43, respectively. Further, heat shield plate fitting bosses 65 are formed in the center portion of the upper wall of the case cover 43 in the front and rear directions and the positions near the fitted bosses 64.

A step 66 extended along the link member 30 near a lower surface of the link member 30 is formed on a left side wall of the case cover 43. The lower side (front lower side) of the case cover 43 from the step 66 has a shape recessed rightward. Thus, a volume of the link mechanism housing chamber 40 is made smaller. A rib 67 for securing stiffness is formed in the portion from the step 66 to the fitted boss 64 near the front lower end of the case cover 43.

(The Configuration of a Breather Mechanism)

In FIG. 4, in the link mechanism housing chamber 40 according to this embodiment, a breather hole 70 is formed at an upper end in a front portion of the case cover 43 so as to effectively exhibit a water-proof function.

Figure 5:
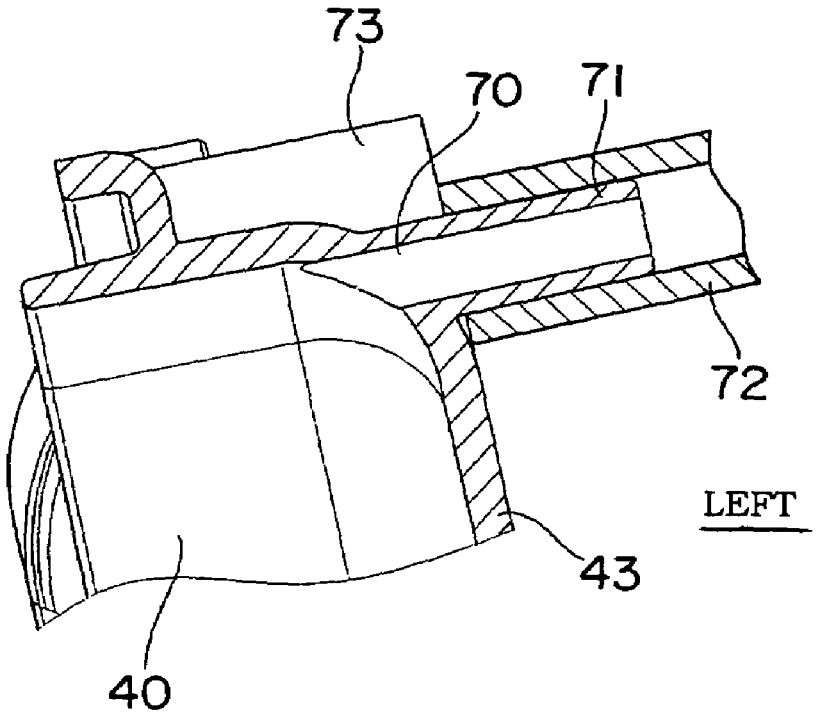
FIG. 5 is an enlarged sectional view taken along line V-V of FIG. 4.

FIG. 5 is an enlarged sectional view of the breather hole 70 (enlarged sectional view taken along line V-V of FIG. 4). The breather hole 70, communicating the inside and the outside of the ink mechanism housing chamber 40, is formed in a cylindrical portion 71 projected leftward from a left side wall of the case cover 43. The cylindrical portion 71 is fitted and connected to one end of a breather pipe 72 made of rubber or resin. A stopper 73 for engaging an edge of the breather pipe 72 in a predetermined position is formed as a rib in a peripheral portion of the cylindrical portion 71.

Returning to FIG. 1, the breather pipe 72 is extended upward and is connected to a dirty side in the air cleaner 14. A breather branch pipe 75 is connected halfway along the breather pipe 72 via a three-way joint pipe 76. The breather branch pipe 75 is connected to the throttle position sensor chamber 22 (see FIG. 2) of the first throttle device 11.

(The Configuration of Other Portions)

In FIG. 1, a rear portion of the upper wall of the case cover 43 is formed integrally with a heat shielding portion 79 projected upward. The heat shielding portion 79 protects an intake air temperature sensor 77 of the air cleaner 14 from outside.

FIG. 1 shows bolts 80 for fitting the cover and bolts 81 for fitting the heat shield plate 45. FIG. 3 shows bolts 83 for fitting the link case 42 to the throttle bodies 11*a* and 12*a*. The pair of front and rear bolts 83 for fitting the link case 43 are arranged to the throttle bodies 11*a* and 12*a*, respectively. The left ends of the throttle bodies 11*a* and 12*a* are fitted into a pair of front and rear mounting holes 57 and 58 formed in the link case 42.

Advantageous of this Embodiment (1) In FIG. 3, as described above, the throttle operating portion such as the accelerator grip 37 is operated by a rider. Throttle operational farce of the accelerator grip 37 is transmitted to the swinging arm 26 of the first throttle device 11 via the cable device 33. The swinging arm 27 of the second throttle device 12 is swung via the link member 30 together with the swinging arm 26 of the first throttle device 11 by substantially the same amount in the same direction. The throttle valves 17 and 18 of FIG. 2 are rotated via the throttle valve driving shafts 24 and 25 so as to be adjusted to a predetermined throttle opening.

(2) While the V-type engine mounted on the vehicle for irregular ground runs on irregular ground such as a field, damp ground, or sandy beach, the outer wall member 41 such as the link case 42 and the case cover 43 is protecting the link member 30 and the swinging arms 26 and 27 incorporated in the link mechanism housing chamber 40 shown in FIG. 3 from a small stone, sand, dust, water, and mud jumped up by a wheel or the like. The mating faces of the link case 42 and the throttle bodies 11*a* and 12*a* and the mating faces of the link case 42 and the case cover 43 shown in FIG. 2 are sealed by the seals 48 and the O ring 49, respectively. Further, the cable insertion hole 52 is sealed by the threaded configuration of the connection pipe 53 having the male thread portion 53*a* and the cable insertion hole 52 having the female thread portion 52*a*. The entry of water and mud from outside into the link mechanism housing chamber 40 can be prevented. The moving portion of the link mechanism 21 can be protected from water and mud.

(3) In FIG. 4, the breather hole 70 is formed in the link mechanism housing chamber 40. In the event that air in the link mechanism housing chamber 40 is expanded or contracted due to temperature change, the pressure in the link mechanism housing chamber 40 can be immediately buffered by breathing so as to be maintained substantially constant. Particularly, in the event that air in the link mechanism housing chamber 40 is contracted, water can be easily taken therein from outside due to pressure decrease in the link mechanism housing chamber 40. In this embodiment, pressure decrease in the link mechanism housing chamber 40 is buffered by breathing. Therefore, the entry of water can be effectively prevented.

(4) In FIG. 3, since the connecting portion of the outer cable 35 and the connection pipe 53 is covered with the boot 55, the entry of water from the connecting portion into the outer cable 35 and the link mechanism housing chamber 40 can be prevented.

(5) As shown in FIGS. 1 and 5, since the breather hole 70 is communicated with the inside of the air cleaner 14 via the breather pipe 72, the entry of water and mud from outside through the breather hole 70 can be prevented.

(6) As shown in FIG. 1, since the breather branch pipe 75 for the throttle position sensor chamber 22 is connected halfway along the breather pipe 72 for the link mechanism housing chamber 40, the piping configuration for the breather can be simplified so that the engine can be made more compact.

(7) As shown in FIG. 2, the heat shield plate 45 made of metal is disposed on the left side wall of the case cover 43. With this figuration, as shown in FIG. 1, when the exhaust pipe 6 is disposed near the link mechanism housing chamber 40, heat from the exhaust pipe 6 can be intercepted to avoid the influence of heat on the case cover 43 and the link case 42 and the influence of heat on air in the link mechanism housing chamber 40.

(8) As shown in FIG. 4, as the shape of the case cover 43, the portion not covering the swinging range of the link member 30, that is, the front lower portion from the step 66, has a shape recessed to the link case side (right side). The volume of the link mechanism housing chamber 40 can be reduced to substantially a minimum. Therefore, the engine can be compact, and pressure change in air in the link mechanism housing chamber 40 can be reduced.

Other Embodiments (1) As the power transmission mechanism, in addition to the link mechanism, a mechanism of wire type, gear type, or chain type may be employed.

(2) In the above embodiment, as the seal means of the link mechanism housing chamber 40, there are employed the O ring 49 between the link case (outer wall configuring member) 42 and the case cover (outer wall configuring member) 43, the seals 48 between the link case (outer wall configuring member) 42 and the throttle bodies (different members) 11*a* and 12*a*, and the threaded configuration of the cable insertion hole (part of the outer wall configuring member) 52 and the connection pipe (different member) 53. The present invention may include any one or two of the three seal means. In the above embodiment, any connected or mated portions of the outer wall member and the different member which need to be sealed other than the portions provided with the seal means may be provided with the seal means.

(2) In the above embodiment, the link case (power transmission mechanism housing chamber case) 42 and the case cover 43 are made of resin. They may be made of metal.

(3) In the above embodiment, as the outer wall member for forming the link mechanism housing chamber, the V-type engine includes the link case (power transmission mechanism housing chamber case) 42 and the case cover 43. The present invention may be employed for the throttle assembly for defining the link mechanism housing chamber 40 only by the link case 42 without including the case cover 43 as the outer wall member.

(4) The above embodiment is the two-cylinder V-type engine. The present invention is applicable to a three or more-cylinder V-type engine. When a plurality of cylinders tilted forward or a plurality of cylinders tilted rearward are arranged in parallel, the throttle valve driving shafts for the cylinders tilted forward are a shared axis and the throttle valve driving shafts for the cylinders tilted rearward are a shared axis. The shared valve driving shafts are coupled to both ends of the link mechanism.

(5) The present invention is not limited to the configuration of the above embodiment. Various modifications can be employed in the scope without departing from the contents described in claims and are included in the present invention. The present invention is applicable, not only to the V-type engine for the four wheeled vehicle for irregular ground, but also to a V-type engine for various vehicles such as a motorcycle or water scooter.

What is claimed is:

1. A throttle assembly for intake air comprising:

a plurality of throttle devices for injecting fuel into intake air to generate air-fuel mixture, wherein each of the throttle devices includes a throttle body;

link mechanism for drivingly connecting driving portions of the throttle devices with each other;

a link mechanism housing chamber defined by a link case connected to mating faces of the throttle bodies of the throttle devices and a case cover connected to a mating face of the link case, the link mechanism housing chamber accommodating the link mechanism; and seal members provided at the mating face of the link case for connecting to the case cover and at the mating faces of the throttle bodies for connecting to the link case.

2. A throttle assembly for intake air, the throttle assembly comprising:

a plurality of throttle devices for injecting fuel into intake air to generate an air-fuel mixture, wherein each of the throttle devices includes a throttle body;

a link mechanism for drivingly connecting driving portions of the throttle devices with each other;

a link mechanism housing chamber defined by a link case connected to mating faces of the throttle bodies of the throttle devices and a case cover connected to a mating face of the link case, the link mechanism housing chamber accommodating the link mechanism;

a first seal member provided at the mating face of the link case for connecting to the case cover; and a second seal member including a cable insertion hole having a female thread portion, the cable insertion hole being screwed with a pipe-shaped connecting portion coupled to an edge of a cable for throttle operation.

3. The throttle assembly for intake air according to claim 1, wherein the link case or the case cover includes a breather hole communicating an inside and an outside of the link mechanism housing chamber.

4. The throttle assembly for intake air according to claim 3, wherein the breather hole includes a connecting portion for connecting a breather pipe communicated with an air cleaner of an engine.

5. The throttle assembly for intake air according to claim 4, wherein the breather hole includes a connecting portion for connecting the breather pipe having a breather branch pipe communicated with a throttle position sensor chamber of the throttle device.

6. A V-type engine including a throttle assembly for intake air, the throttle assembly for intake air comprising:

a plurality of throttle devices for injecting fuel into intake air to generate air-fuel mixture;

link mechanism for connecting drivingly driving portions of the throttle devices with each other;

link mechanism housing chamber defined by a link case connected to mating faces of throttle bodies of the throttle devices and a case cover connected to a mating face of the link case, the link mechanism housing chamber accommodating the link mechanism; and seal members provided at the mating face of the link case for connecting to the case cover and at the mating faces of the throttle bodies fix connecting to the link case.

7. The throttle assembly for intake air according to claim 2, wherein the link case or the case cover includes a breather hole communicating an inside and an outside of the link mechanism housing chamber.

8. The throttle assembly for intake air according to claim 7, wherein the breather hole includes a connecting portion for connecting a breather pipe communicated with an air cleaner of an engine.

9. The throttle assembly for intake air according to claim 8, wherein the breather hole includes a connecting portion for connecting the breather pipe having a breather branch pipe communicated with a throttle position sensor chamber of the throttle device.

10. The throttle assembly for intake air according to claim 1, wherein the link mechanism comprises a plurality of swinging arms for driving the throttle devices and a link member connecting the swinging arms with each other, and the swinging arms and the link member are accommodated in the link mechanism housing chamber.

11. The throttle assembly for intake air according to claim 2, wherein the link mechanism comprises a plurality of swinging arms for driving the throttle devices and a link member connecting the swinging arms with each other, and the swinging arms and the link member are accommodated in the link mechanism housing chamber.

12. The throttle assembly for intake air according to claim 3, wherein the link mechanism comprises a plurality of swinging arms for driving the throttle devices and a link member connecting the swinging arms with each other, and the swinging arms and the link member are accommodated in the link mechanism housing chamber.

13. The throttle assembly for intake air according to claim 4, wherein the link mechanism comprises a plurality of swinging arms for driving the throttle devices and a link member connecting the swinging arms with each other, and the swinging arms and the link member are accommodated in the link mechanism housing chamber.

14. The throttle assembly for intake air according to claim 5, wherein the link mechanism comprises a plurality of swinging antis for driving the throttle devices and a link member connecting the swinging arms with each other, and the swinging antis and the link member are accommodated in the link mechanism housing chamber.

15. The throttle assembly for intake air according to claim 2, further comprising seal members provided at the mating faces of the throttle bodies for connecting to the link case.

* * * * *